US006523558B1

(12) United States Patent
Gillis

(10) Patent No.: US 6,523,558 B1
(45) Date of Patent: Feb. 25, 2003

(54) POLE CONNECTOR FOR FLEXIBLE STRUCTURE

(76) Inventor: Robert E. Gillis, 224 W. O'Connor, Menlo Park, CA (US) 94025

( * ) Notice: Subject to any disclaimer, the term of this patent is extended or adjusted under 35 U.S.C. 154(b) by 0 days.

(21) Appl. No.: 09/608,063

(22) Filed: Jun. 29, 2000

(51) Int. Cl.[7] ..... E04H 15/00
(52) U.S. Cl. ..... 135/87; 135/119; 135/125
(58) Field of Search ..... 135/87, 114, 119, 135/125

(56) References Cited

U.S. PATENT DOCUMENTS

| | | | | |
|---|---|---|---|---|
| 1,520,719 A | * | 12/1924 | Plinkton | |
| 2,777,454 A | * | 1/1957 | Kramer | |
| 3,314,630 A | | 4/1967 | Lewis, Sr. | |
| 3,425,428 A | * | 2/1969 | Schwartz | |
| 3,749,107 A | | 7/1973 | Laberge | |
| 3,834,410 A | | 9/1974 | Leibel | |
| 3,863,659 A | | 2/1975 | Gillis | |
| 3,986,519 A | | 10/1976 | Gillis | |
| 4,099,533 A | | 7/1978 | Gillis | |
| 4,175,305 A | | 11/1979 | Gillis | |
| 4,265,259 A | | 5/1981 | Gillis | |
| 4,265,260 A | | 5/1981 | Gillis | |
| 4,308,647 A | | 1/1982 | Gillis | |
| 4,414,993 A | | 11/1983 | Gillis | |
| 4,580,372 A | * | 4/1986 | Osborn | |
| 4,706,696 A | | 11/1987 | Gillis | |
| 4,809,726 A | | 3/1989 | Gillis | |
| 4,944,322 A | | 7/1990 | Gillis | |
| 5,477,876 A | * | 12/1995 | Moss | 135/114 X |
| 5,490,532 A | * | 2/1996 | Mallookis et al. | 135/114 X |
| 5,642,750 A | | 7/1997 | Brown | |
| 5,918,614 A | * | 7/1999 | Lynch | 135/119 X |

FOREIGN PATENT DOCUMENTS

| | | |
|---|---|---|
| DE | 2521913 | 11/1976 |
| GB | 1103575 | 5/1965 |

OTHER PUBLICATIONS (5) Sierra Designs Catalogs depicting tents and connectors, Sierra Designs, 1255 Powell Street, Emeryville, California 94608.

(1) Recreational Equipment Inc. Catalog depicting tents and connectors, 1700 45th Street East, Sumner, Washington 98390.

Mountain Hard Wear Catalog, pp. 6–15 depicting tents and connectors, 950 Gilman Street, Berkeley, California 94710.

(2) The North Face brochures, pp. 8–17 and pp. 30–37, The North Face, 999 Harrison Street, Berkeley, California 94710.

* cited by examiner

*Primary Examiner*—Robert W. Gibson, Jr.
(74) *Attorney, Agent, or Firm*—Townsend and Townsend and Crew LLP

(57) ABSTRACT

A connector connects the end segments of one or more poles and a flexible membrane to form a tent, canopy, kite or other flexible shelter or non-shelter structure. The connector has a first and a second body section that are adapted to mate via loosely coupled threads in one adaptation. A portion of a flexible membrane is retained between the two body sections. The first body section has an open end and is adapted to engage an end segment of a pole. The second body section is adapted to be fitted with a ring, hook, or other structure to which a guy wire, rope, or other pole may be connected.

22 Claims, 3 Drawing Sheets

POLE CONNECTOR FOR FLEXIBLE STRUCTURE

BACKGROUND OF THE INVENTION

1. Field of the Invention

The present invention relates generally to flexible structures such as tents and canopies, and more specifically to flexible structures in which a flexible membrane or fabric overlies and is supported by one or more poles. Still more specifically, the present invention relates to a connector for connecting the ends of such poles with a portion of overlying flexible membrane or fabric.

2. Description of the Prior Art

Numerous types and styles of flexible structures such as tents and canopies exist in the prior art. Flexible tent structures are commonly used for recreational purposes, such as camping. Numerous types and styles of tent structures are known. Many share as a common characteristic that a flexible structure is defined by one or more poles, which are connected to and support a flexible membrane or fabric to define a sheltered space. In some such structures, such as various dome style tents, the poles are resilient and are flexed under tension. In other structures, for example "A" frame tents, various tensegrity structures, and lean-to's, the poles may be rigid and generally angled upright from the plane of a base surface, such as the ground. Various means have been used to connect the flexible membrane and the poles in known tent structures. For example, rings, fabric sleeves, and various styles of clips are all known. The inventor of the present invention has patented a number of different flexible structure designs, which include various pole connectors. These are illustrated in U.S. Pat. Nos. 3,986,519; 3,863,659; 4,099,533; 4,175,305; 4,265,260; 4,265,259; 4,308,647; 4,414,993; 4,706,696; 4,809,726; and 4,994,322.

Another type of flexible structure, sometimes called a canopy, has often been used to create sheltered space for entertainment or entertaining. For example, canopies are typically used by circuses and other forms of entertainment to create large sheltered spaces for performers and spectators. Smaller canopy style structures are also often used to create sheltered space for various purposes at smaller events. Examples include space for catered food service, a portable dance floor, sun protection, and other purposes. Unlike many flexible tent structures, canopy type structures are often used to define much larger sheltered spaces. Like A-frame style tents and tensegrity structures, such structures typically employ one or more rigid upright poles. A flexible fabric typically overlies the poles and is stretched to the ground or other base surface and held under tension by cables, ropes, stakes, and the like. In many cases, the flexible membrane is not connected directly to the tops of the upright poles, but may be provided with an extra thick protective layer, such as a leather layer, at the points where the membrane contacts the tops of the poles. This is to prevent the poles from tearing through the membrane. In some very large canopy structures, such as some circus canopies, the poles do not contact the overlying membrane at all. In such canopy designs, holes are formed in the membrane at the points where the membrane would contact the tops of the poles. The poles protrude through the openings, and the membranes are connected to the tops of the poles via cables or ropes, rings, etc.

The need to precisely position the flexible membrane in order to align the tops of the poles and the protective layers or holes, and the need in some cases to make additional connections between the poles and the membrane via cables, ropes, etc., make the task of setting up and tearing down flexible canopy structures, A-frame style tents, and tensegrity structures more time consuming and problematic than necessary. Moreover, flexibility in defining a sheltered space is limited when the poles must connect to a flexible membrane at defined locations. What is needed therefore is a connector that can connect the ends of the poles and the flexible membrane in such flexible structures quickly, easily, flexibly, without requiring precise alignment or positioning, and without damaging the membrane. It would also be advantageous for such a connector to be flexible enough in application to be useful in constructing flexible structures other than shelter structures, such as kites and hang-gliders, for example.

The various connectors previously disclosed by the inventor (see the above-identified patents) for flexible tent structures are not entirely suitable for the present purposes. These connectors show various means for connecting flexible membranes with resilient poles that are flexed under tension, including a unique two piece clip design marketed under the name "Grip Clip," and a two piece "barrel" design that employs loosely mating male and female threads to grip a membrane between them. However, none of the foregoing designs are able to connect membranes to the ends of supporting poles to construct certain types of flexible structures like A-frame tents, canopies, and tensegrity structures.

It is an objective of the present invention to overcome these problems and limitations of the prior art, and to provide advantages over previously known means and methods of connecting flexible membranes to the ends of poles in certain types of flexible structures.

More specifically, it is an objective of the present invention to provide a connector that can securely connect selected portions of a flexible membrane to the ends of poles in order to construct certain types of flexible structures.

It is a further objective to provide such a connector that eliminates the need to provide a protective layer or hole in the membrane to prevent damage to the membrane.

It is a further objective to provide a connector that eliminates the need to precisely align or position a portion of the flexible membrane with the end of a pole in order to construct a flexible structure.

It is a still further object to provide a connector that eliminates the need to make additional connections between a flexible membrane and a pole in order to securely couple the two.

It is a still further object to provide a connector that makes construction and disassembly of flexible structures easier and less time consuming.

It is a still further object to provide a connector that is flexible in use to construct a wide variety of flexible structures including both shelter defining structures, such as tents and canopies, and other structures, such as tents and hang-gliders.

SUMMARY OF THE INVENTION

The present invention provides the aforementioned solutions and advantages by providing a pole connector comprising a first body section and a second corresponding body section, which are adapted to mate with each other in a fashion to secure a selected portion of flexible membrane therebetween. In one adaptation, the first and second body members are adapted to mate via loosely aligned male and female threads. The first body section is open at one end and adapted to receive and engage the end segment of a pole. The first body section may be fitted with a variety of indents, pins, or other fittings to ensure secure engagement of the end segment of the pole. The second body section may be fitted with a variety of attachments such as loops, hooks, rings, or other structures to facilitate connection to guy wires, ropes, other poles, or the like.

In a second aspect, the invention provides a flexible structure comprising a flexible membrane and one or more poles having ends adjacent to and underling the flexible membrane to support the membrane and define a sheltered space beneath it. The poles and membrane are coupled by one or more connectors. The connectors have first and second body sections, with the first body sections receiving the ends of the poles adjacent the membrane. The first and second body sections are selectively coupled with selected portions of the membrane being engaged therebetween.

DETAILED DESCRIPTION OF THE PRESENTLY PREFERRED EMBODIMENT

A better understanding of the invention will be obtained by reading the following detailed description of the presently preferred embodiments, with reference to the attached drawings, in which like parts are identified using like numbers.

Figure 1:
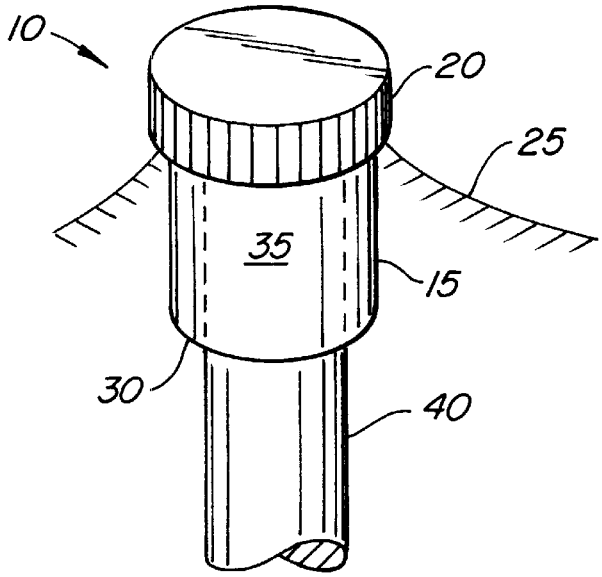
FIG. 1 is a side elevation view of a presently preferred embodiment of the pole connector of the invention coupling a pole and flexible membrane.

FIG. 1 illustrates a simple preferred configuration of a pole connector 10 of the present invention shown coupling the end segment of a rigid pole and a portion of a flexible membrane. The preferred pole connector includes a first body section 15 and a second body section 20. The first and second body sections are adapted to mate and to retain a portion of a flexible membrane 25 therebetween. The first body section 15 is preferably provided with an open end 30 for receiving the end segment 35 of a rigid pole 40. The first and second body sections of the connector may be made from a variety of materials suitable for use in tents and similar flexible shelter structures, including various plastics. The first and second body sections may be adapted to mate via a variety of known mechanisms including without limitation cooperating male and female threads, bayonet style fittings, and even a simple friction fit. Preferably the mating connection selected will be suitable to securely engage and retain a flexible membrane, which may be any of a variety of known materials ranging from polypropylene tarp material to rayon tent fabric, between the two body sections, without puncturing, tearing, or otherwise permanently damaging the flexible membrane. Thus, in the case of a threaded mating connection, for example, depending on the material of the flexible membrane, the retention strength desired, and other factors that will be readily apparent to those skilled in the art, it may be desirable to provide relatively loosely fitting threads, i.e., threads sufficient to retain the coupling between the first and second body sections, but providing sufficient spacing to enable retention of the flexible membrane without damaging the material. Similar considerations may also exist with respect to other mating connections, such as a bayonet style connection.

The first body section preferably defines an interior space sufficient to accept the end segment of the rigid pole with which the connector is to be used. The actual length, volume, and shape of the interior space, and the shape and area of the opening leading to it, are dependent on the needs and desires of the designer and the application envisioned. In some instances it may be preferable to shape the opening and the interior space according to the shape of the pole in order to facilitate engagement and retention of the pole. For example, if a hexagonal shaped pole is employed, a similarly hexagonal shaped opening and interior space may be used. Also, engagement and retention of the pole end segment may be enhanced by sizing the opening and the interior space to provide a friction connection between the surface of the pole end segment and the interior surface of the first body section.

Figure 2:
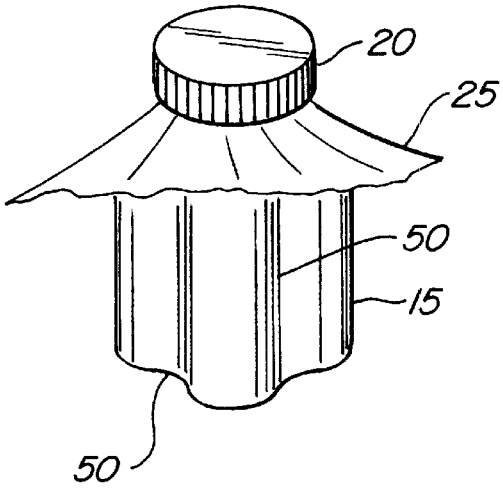
FIG. 2 is another side elevation view of another presently preferred embodiment having a slight variation for facilitating retention of a pole end segment by the preferred connector.
Figure 2A:
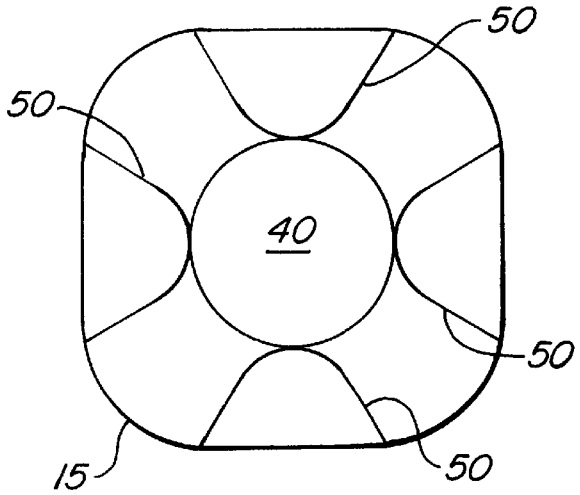
FIG. 2*a* is a bottom plan view of the preferred embodiment of FIG. 2.

FIGS. 2 and 2*a* illustrate another preferred embodiment having a slight variation in the shape of the first body section which facilitates engagement and retention of the pole end segment. In this preferred embodiment, the first body section 15 is integrally formed with a number of indented ribs 50 extending longitudinally along the axis of the pole end segment to be engaged. The ribs 50 are intended to extend far enough into the interior space formed by the first body section to generate a press or friction fit with the pole end segment. Of course persons skilled in the art will recognize that a friction connection between the pole end segment and the first body section can also be accomplished in numerous other ways, including for example, tapering the interior space of the first body section relative to the pole end segment, providing nobs or other protrusions on the inside walls of the first body section, providing nobs or other protrusions on the exterior surfaces of the pole end segment, and so on. Other means may also be used to couple the pole end segment to the first body section including threaded arrangements, bayonet type connections, hole and cotter pin arrangements, and the like.

Figure 3:
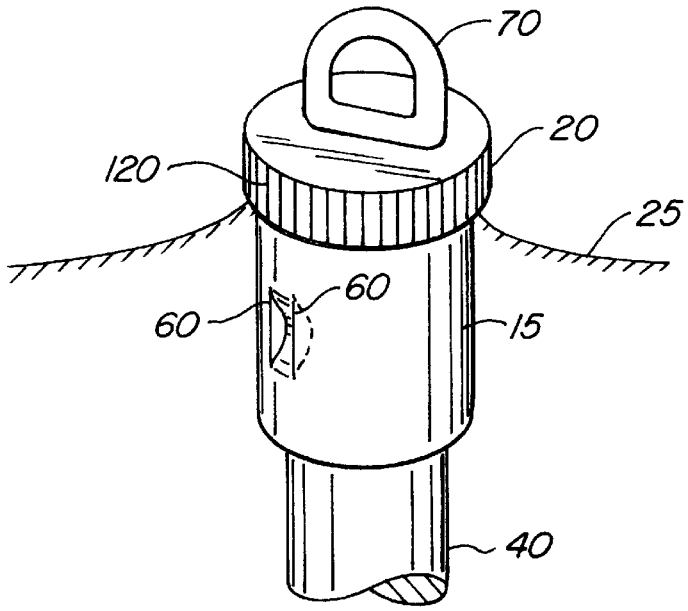
FIG. 3 is yet another side elevation view of another presently preferred embodiment of the pole connector having variations for facilitating retention of an end segment of a pole and an insert for connecting to a guy wire, rope or other pole structure, for example.

FIG. 3 shows another preferred embodiment wherein the first body section 15 is formed with another form of indent 60 which preferably is shaped to facilitate entry of the end segment of pole 40 into first body section 15 and which preferably extends inwardly a sufficient distance to frictionally engage the end segment of pole 40 to retain it within first body section 15. For example, indent 60 may be semi-rounded or curved to facilitate entry of the end segment of pole 40 while providing spring action to frictionally engage the surface of pole 40. Although not shown, those skilled in the art will appreciate that a corresponding notch or other structure may be formed in the surface of the end segment of pole 40 to engage the indent 60, if desired. Additionally, while only one such indent 60 is shown in FIG. 3, a plurality of such indents may be provided, as shown for example in FIG. 5.

Figure 4:
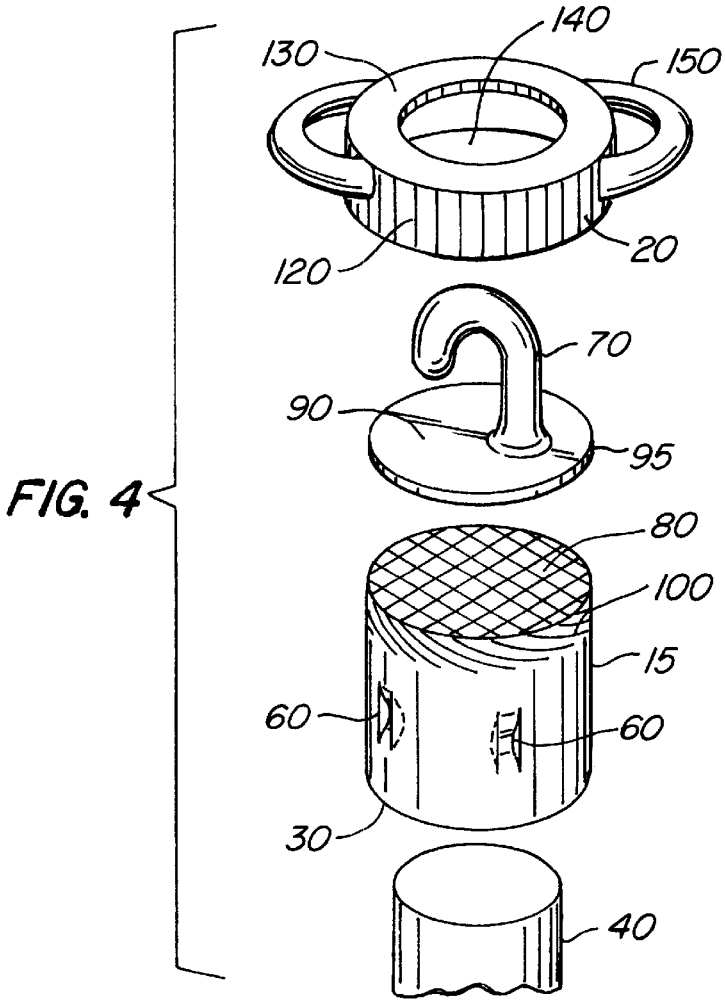
FIG. 4 is an exploded side elevation view of yet another preferred embodiment of the pole connector showing the relationship between first and second body sections and an attachment insert.
Figure 5:
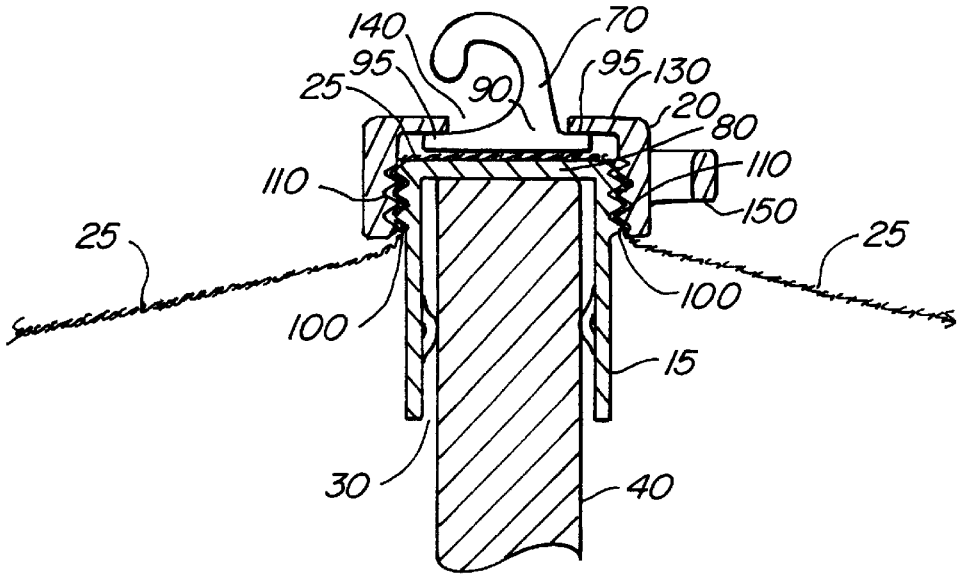
FIG. 5 is a side cutaway view of the preferred embodiment shown in FIG. 4.

The preferred embodiment of FIG. 3 also includes an attachment 70 in the form of a ring which couples with the second body section 20. Attachment 70 may be integrally formed with second body section 20, or may be in the form of an insert (as shown in FIG. 4) which is mechanically coupled with the second body section 20. Attachment 70 may take a variety of shapes including the ring shown in FIG. 3, a hook as shown in FIGS. 4 and 5, or any other desired structure. It is anticipated that the attachment 70 may find use in securing additional poles, guy wires, or other structural elements, depending on the design and use of the structure involved. As in FIGS. 1 and 2, a portion of a flexible membrane 25 is engaged between the first and second body sections 15 and 20 respectively to couple the end segment of pole 40 thereto.

Referring to FIGS. 4 and 5, the assembly of a preferred embodiment of the invention will now be described. As previously described, the first body section 15 has an opening 30 at one end and defines an interior space to receive the end segment of pole 40. The first body section engages the pole 40 frictionally with a plurality of indents 60 formed within the first body section or by other suitable means, examples of which have been previously described. Preferably, the end of the first body section 15 opposite the opening 30 forms a completely or partially solid surface 80, which engages the end of pole 40 and prevents it from tearing or otherwise damaging the portion of flexible membrane to be engaged between the first and second body sections 15 and 20 respectively, as shown in FIG. 5. While the surface 80 is shown completely solid in FIG. 4, it will be appreciated that various alternatives are possible. The surface 80 may also be partially solid, for example in the form of a criss-crossed net pattern, or in the form of a flange extending around the periphery of the first body section with a central opening. Other similar variations are also acceptable, the objective being to prevent the end of the pole 40 from damaging the flexible membrane 25.

First body section 15 is preferably provided with a first set of threads 100 extending circumferentially around its outer surface. Second body section 20 is preferably provided with a corresponding second set of threads 110 extending circumferentially around its inner surface and located and shaped to couple with threads 100 by rotatably screwing the second body portion 20 onto the first body portion 15. Preferably the first and second sets of threads 100 and 110 respectively are positioned so as to couple the first and second body sections 15 and 20 respectively relatively loosely in order to engage a portion of flexible membrane 25 therebetween without damaging it. The specific dimensions and fit of the threads will depend on the fabric of the membrane, the desired tightness of the connection and other design factors, and is well within the skill of persons of ordinary skill in the art to determine and select.

Preferably, the outer surface of the second body section is provided with a set of ribs or other protrusions 120 to facilitate manually gripping the second body section and coupling it with the first body section. As previously described, alternative forms of connection, such as a bayonet style connection may also be used without varying from the spirit of the invention.

Also preferably, the second body section 20 is provided with a circumferentially extending flange 130 and a central opening 140 to facilitate coupling an attachment 70. The second body section 20 may, if desired, be provided with various structural elements, such as pull tabs 150, which can facilitate connection to ropes, cables, guy wires, or the like, which may be desirable depending on the design of a given structure.

The attachment 70 preferably has a relatively flat, thin base 90 with a circumferentially extending outer lip 95. The base 90 and lip 95 are preferably shaped and sized to engage and be supported by the outer portion of surface 80. The hook or other structure extends through the central opening 140 of the second body section 15 and the base 90 and lip 95 are engaged between the flange 130 of second body section 15 and the surface 80 of first body section 15 when the two are coupled together. If desired the surfaces of surface 80, the base 90, lip 95, and flange 130 may be roughened or provided with surface protrusions and/or indentations (not shown) to engage each other frictionally and prevent slippage or other movement in use.

Figure 6:
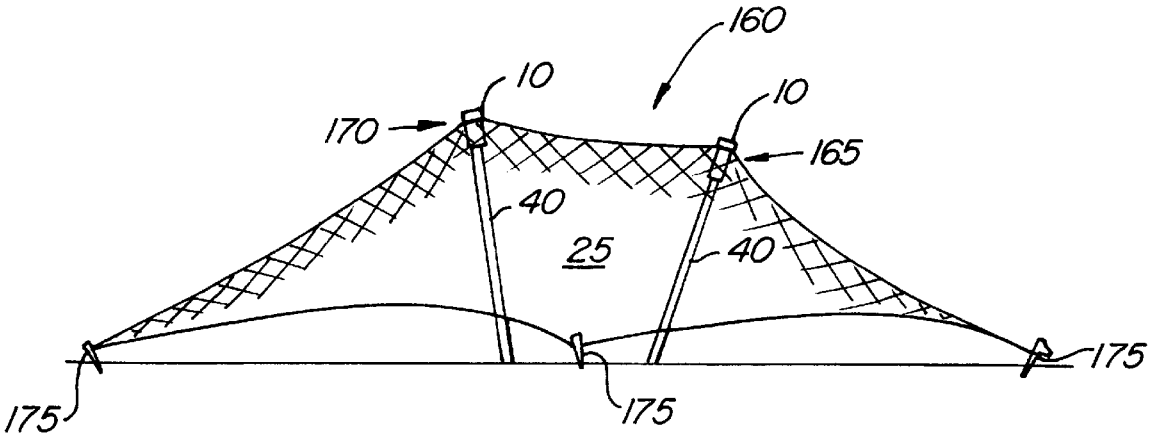
FIG. 6 is a side elevation view of a tent structure formed from a flexible membrane connected to the end segments of rigid poles by the pole connector of the present invention.

The pole connector of the present invention can be used to create a wide variety of different flexible structures, including various tents, canopies, tensegrity structures, lean-to's, and the like. Indeed, the pole connector of the present invention will be useful in any application in which it is desired to connect a portion of a flexible membrane to the end segment of a rigid pole. One exemplary tensegrity structure 160 which can be constructed using the pole connector of the present invention is shown in FIG. 6. As shown, the tensegrity structure 160 comprises a flexible membrane 25, which is engaged at spaced locations 165 and 170 by pole connectors 10 in the manner previously described. Rigid poles 40 are inserted into the pole connectors and are engaged thereby at their respective ends. The poles are maneuvered into a generally upright or angled orientation, thereby elevating at least a section of the membrane 25 and forming a sheltered space beneath it. The ends of the poles opposite the ends engaged by the pole connectors may extend into contact with some form of base or support, such as the ground. The flexible membrane 25 may be further tensioned, the sheltered space further defined, and the structure further secured by securing the periphery of the membrane to the ground or other base structure via loops (not shown) and stakes 175 at selected locations. While only two poles and pole connectors are shown in the examplary structure, persons skilled in the art will readily realize that more or fewer poles and pole connectors may be used, depending on the design of the flexible structure. Moreover, while not shown, it will be readily apparent to persons skilled in the art that additional ropes, guy wires, and the like may be used to further define and secure the structure as desired or as necessary. Still further, it will be readily apparent to persons skilled in the art that while rigid poles are shown, resilient poles might be used in their stead, depending upon the design of the structure, and that while only one end of each pole is shown engaged with a section of flexible membrane, both ends of one or more poles may be so engaged. Indeed, in a different type of flexible structure, such as a kite, two resilient poles might be used with both ends of each being connected to a portion of flexible membrane defining the body of the kite.

The foregoing detailed description of the presently preferred embodiments of the invention are intended to be exemplary rather than limiting in nature. Numerous variations to the described embodiments in terms of materials, sizes, shapes, structure designs, and mechanical interconnections will be readily apparent to those skilled in the art and can be implemented without departing from the spirit of the invention, the scope of which is intended to be defined solely by the appended claims.

What is claimed is:

1. A connector for connecting a pole and a flexible membrane, comprising:

a first body section having an opening at one end adapted to receive an end of said pole; and a second body section selectively coupleable to said first body section, such that a portion of said flexible membrane may be engaged therebetween without puncturing said flexible membrane.

2. The connector of claim 1 wherein said first and said second body sections include corresponding means for coupling said second body section to said first body section.

3. The connector of claim 2 wherein said means for coupling comprise threads.

4. The connector of claim 1 wherein said first body section includes a first end for receiving said end of said pole and a second end adapted to engage said second body section.

5. The connector of claim 4 wherein:

said first end of said first body section comprises an opening;

said second body section includes a flange; and said second end of said first body section comprises a surface adapted to engage said flange.

6. The connector of claim 1 wherein said first body section includes means for engaging said end of said pole.

7. The connector of claim 6 wherein said means for engaging said end of said pole comprises means for frictionally engaging said end of said pole.

8. The connector of claim 6 wherein said means for engaging said end of said pole comprises structure adapted to cooperate with corresponding structure of said pole.

9. The connector of claim 1 including an attachment adapted to be engaged between said first and said second body sections.

10. The connector of claim 1 including an attachment integrally formed with said second body section.

11. The connector of claim 9 wherein said attachment includes one of a ring or a hook structure.

12. The connector of claim 11 wherein said second body section includes an opening for accessing said attachment.

13. A flexible structure comprising:

a flexible membrane having an area bounded by a periphery;

a pole having a first end adjacent and underlying a portion of said area of flexible membrane, and a second end;

a connector comprising a first body section and a second body section, said first body section being coupled with said first end of said pole and said first and second body sections being selectively coupled with said portion of said flexible membrane big engaged therebetween and not being punctured.

14. The flexible structure of claim 13 including a plurality of said poles and a plurality of said connectors.

15. The flexible structure of claim 14 wherein said second ends of said poles extend into contact with a support base.

16. The flexible structure of claim 14 including means dispersed about said periphery of said flexible membrane to engage said support base, thereby defining a sheltered space beneath said flexible membrane.

17. The flexible structure of claim 13 including a second connector and wherein said second end of said pole is connected to a second portion of said flexible membrane via said second connector.

18. A connector for connecting a pole and a flexible membrane, comprising:

a first body section adapted to receive an end of said pole;

a second body section selectively coupleable to said first body section, such that a portion of said flexible membrane may be engaged therebetween, said second body section including an attachment adapted to be engaged between said first and second body sections.

19. A connector for connecting a pole and a flexible membrane, comprising:

a first body section having an opening at one end adapted to receive an end of said pole; and a second body section selectively coupleable to said first body section, such that a portion of said flexible membrane may be engaged therebetween, said second body section including an attachment.

20. The connector of claim 19 wherein said second body section includes an opening for accessing said attachment.

21. A connector for connecting a pole and a flexible membrane, comprising:

a first body section adapted to receive an end of said pole;

a second body section selectively coupleable to said first body section, such that a portion of said flexible membrane may be engaged therebetween, said second body section including an attachment.

22. The connector of claim 21 wherein said attachment includes one of a ring or a hook structure.

* * * * *